US009245512B2

(12) United States Patent
Sernit et al.

(10) Patent No.: US 9,245,512 B2
(45) Date of Patent: Jan. 26, 2016

(54) ACOUSTIC ANTENNA ELEMENT FOR EMITTING AND/OR RECEIVING WAVES UNDER WATER AND ASSOCIATED ACOUSTIC ANTENNA

(71) Applicant: THALES, Neuilly/sur/Seine (FR)

(72) Inventors: Eric Sernit, Moulans-Sartoux (FR); Jean-Marcelin Pascal, Nice (FR)

(73) Assignee: THALES, Courbevoie (FR)

( * ) Notice: Subject to any disclaimer, the term of this patent is extended or adjusted under 35 U.S.C. 154(b) by 106 days.

(21) Appl. No.: 14/367,838

(22) PCT Filed: Dec. 11, 2012

(86) PCT No.: PCT/EP2012/075130

§ 371 (c)(1),
(2) Date: Jun. 20, 2014

(87) PCT Pub. No.: WO2013/092320

PCT Pub. Date: Jun. 27, 2013

(65) Prior Publication Data

US 2015/0294661 A1 Oct. 15, 2015

(30) Foreign Application Priority Data

Dec. 23, 2011 (FR) ..... 11 04073

(51) Int. Cl.

| | |
|---|---|
| ***G10K 11/00*** | (2006.01) |
| ***B63G 8/39*** | (2006.01) |
| *B63G 9/00* | (2006.01) |

(52) U.S. Cl.
CPC ..... *G10K 11/008* (2013.01); *B63G 8/39* (2013.01); *B63G 2009/005* (2013.01)

(58) Field of Classification Search
CPC ... B63G 8/39; B63G 2009/005; G10K 11/008
See application file for complete search history.

(56) References Cited

U.S. PATENT DOCUMENTS

| | | | | |
|---|---|---|---|---|
| 4,745,584 | A | 5/1988 | Andersen | |
| 4,833,659 | A | 5/1989 | Geil et al. | |
| 5,517,467 | A | 5/1996 | Fromont et al. | |
| 6,314,811 | B1 | 11/2001 | Goldner et al. | |
| 2002/0085452 | A1 | 7/2002 | Scanlon | |
| 2015/0294661 | A1 * | 10/2015 | Sernit | B63G 8/39 367/173 |

FOREIGN PATENT DOCUMENTS

| | | | | |
|---|---|---|---|---|
| FR | 2984771 | A1 * | 6/2013 | B63G 8/39 |
| FR | WO 2013092320 | A1 * | 6/2013 | B63G 8/39 |
| FR | KR 20140119042 | A * | 10/2014 | B63G 8/39 |

OTHER PUBLICATIONS

Search Report dated Jan. 25, 2013, from International Patent Application No. PCT/EP2012/075130.

* cited by examiner

*Primary Examiner* — Daniel Pihulic
(74) *Attorney, Agent, or Firm* — Baker & Hostetler LLP

(57) ABSTRACT

An acoustic antenna element for receiving and/or emitting low-frequency underwater waves comprises an acoustic panel formed by at least one acoustic pick-up enclosed in a flexible jacket, the acoustic panel being generally rectangular and being mounted against a curved support by a mounting device including a clamping device comprising at least two flanges the ends of which are mounted on the support, the respective flanges comprising at least one tie between the two ends thereof, and the clamping device capable of adjusting the tension in the ties between the two respective ends thereof, the flanges being arranged so that the support is bent between the two respective ends of the ties and so that the panel is clamped against the support by the ties when they are under tension.

15 Claims, 4 Drawing Sheets

ACOUSTIC ANTENNA ELEMENT FOR EMITTING AND/OR RECEIVING WAVES UNDER WATER AND ASSOCIATED ACOUSTIC ANTENNA

CROSS-REFERENCE TO RELATED APPLICATIONS

This application is a National Stage of International patent application PCT/EP2012/075130, filed on Dec. 11, 2012, which claims priority to foreign French patent application No. FR 1104073, filed on Dec. 23, 2011, the disclosures of which are incorporated by reference in their entirety.

FIELD OF THE INVENTION

The present invention concerns an acoustic antenna for emitting and/or receiving medium-frequency waves under water.

BACKGROUND

Such an antenna is intended to detect and to locate underwater sources of acoustic noise, for example. To obtain good performance both in detection and in location, it is necessary to work over a spectrum of low or medium frequencies and to have an antenna the gain of which is high in order to obtain a satisfactory signal to noise ratio (in numerous applications a gain of 20 dB is necessary). By medium frequencies is meant frequencies lower than 12 kHz.

At present, acoustic antennas for receiving underwater waves include acoustic sensors that will be referred to as acoustic panels in the remainder of the text. These acoustic sensors include at least one acoustic pick-up enclosed in a flexible material coating. The assembly thus constituted forms an acoustic panel referred to as an acoustic panel. An acoustic panel has a globally rectangular shape.

The acoustic panels are mounted on a support, for example on the hull of a submarine. The acoustic panels have a degree of freedom in bending so as to be able to mate with the shape of this hull.

The panels are held against the wall by clamping them by means of two flanges attached along the longer sides of the acoustic panels. The acoustic panels are sandwiched between the flanges and the hull of the submarine. The ends of the flanges are mounted on rails on either side of the panels extending longitudinally in the direction of the width of the panels.

The flanges have a curved shape approximating the curvature of the submarine, which enables them to clamp the acoustic panels against the hull of the submarine.

Now, at present, rigid metal flanges are used. They provide effective clamping of the acoustic panels only on a hull having a predetermined curvature.

This clamping solution has a certain number of disadvantages. Because of manufacturing tolerances in respect of the hull of a submarine and also the flanges, it can happen that the clamping of the acoustic panels is not efficacious. If the curvature of the hull is less than foreseen (radius of curvature greater than foreseen) or if the curvature of the flanges is greater than foreseen (radius of curvature less than foreseen), the acoustic panels are not correctly clamped against the hull of the submarine. Knowing also that the acoustic panels may be deformed because of hydrodynamic disturbances, there is therefore a risk of the panels escaping from their fixing flanges.

On the other hand, if the curvature of the hull is greater than foreseen (radius of curvature less than foreseen) or if the curvature of the flanges is less than foreseen (radius of curvature greater than foreseen), the acoustic panels clamp the panels too firmly, which leads to premature wear of the panels.

Moreover, it is necessary to provide different flanges for different submarines the hulls of which have different radii of curvature or for a single submarine the hull of which has a varying radius of curvature.

SUMMARY OF THE INVENTION

The object of the invention is to remedy the aforementioned disadvantages.

To this end, the invention consists in an acoustic antenna element for receiving and/or emitting low-frequency underwater waves, comprising an acoustic panel formed by at least one acoustic pick-up enclosed in a flexible jacket, said acoustic panel being generally rectangular and being mounted against a curved support by means of a mounting device including a clamping device comprising at least two flanges the ends of which are mounted on said support. The respective flanges comprise at least one tie between the two ends thereof and the clamping device comprises means for adjusting the tension of said ties between the two respective ends thereof, the flanges being arranged so that the support is curved between the two respective ends of said ties and so that the panel is clamped against the support by said ties when they are under tension.

Thus a single clamping device can be provided for clamping acoustic panels to supports having different radii of curvature. A single device can be used on a submarine having a varying radius of curvature or on different submarines having different radii of curvature. Moreover, the clamping device clamps the panel against the hull of the submarine even if the latter features irregularities and is not perfectly convex. Also, this clamping device makes it possible to prevent premature wear of the acoustic panels by the means for adjusting the tension of the ties.

An antenna in accordance with the invention comprising one or more elements in accordance with the invention is therefore of low cost and resistant to hydrodynamic stresses (because the acoustic panels are firmly clamped against their support).

Moreover, the antenna in accordance with the invention has good acoustic performance because of the use of ties.

At least one of said ties advantageously takes the form of a flexible strip.

At least one of said ties advantageously takes the form of a metal cable sheathed by means of a flexible sheath.

At least one of said flanges advantageously consists of a tie.

At least one of said ties is advantageously fastened to the panel.

The panel is advantageously sandwiched between at least one of said ties and the support.

At least one of said ties is advantageously at least partially accommodated in a channel opening onto the face of the panel facing the environment external to the support, referred to as the external face.

At least one of said ties is advantageously flush with the external face of the panel.

The volume of said passage that is not occupied by said at least one of said ties is advantageously caulked by means of a caulking material so that the surface formed by the caulking material and said at least one of said ties is flush with the external face of the panel.

At least one of said ties is advantageously at least partially accommodated in a passage extending over all the length or over all the width of said panel.

The clamping means advantageously comprise at least three flanges.

The flanges are advantageously adapted to clamp the panel against the support exclusively via said ties under tension.

The invention also consists in an antenna comprising a plurality of elements according to the invention.

The invention also consists in a ship equipped with an antenna according to the invention.

The invention further consists in a method of mounting an acoustic panel formed by at least one acoustic pick-up enclosed in a flexible jacket, said acoustic panel being globally rectangular, against a curved support, comprising:

a step in which the panel is attached to a support, a step in which the panel is clamped against the support by means of a clamping device comprising at least two flanges each comprising at least one tie between its two ends and means for adjusting the tension of said ties between their respective two ends, said clamping step comprising a step during which said flanges are arranged so that the support is curved between the respective two ends of said ties and so as to clamp the panel against the support via said ties under tension, said ties being fastened to the panel when the panel is mounted on the support.

BRIEF DESCRIPTION OF THE DRAWINGS

Other features and advantages of the invention will become apparent on reading the following detailed description, given by way of nonlimiting example and with reference to the appended drawings, in which.

DETAILED DESCRIPTION

From one figure to another, the same elements are identified by the same references.

Figure 1:
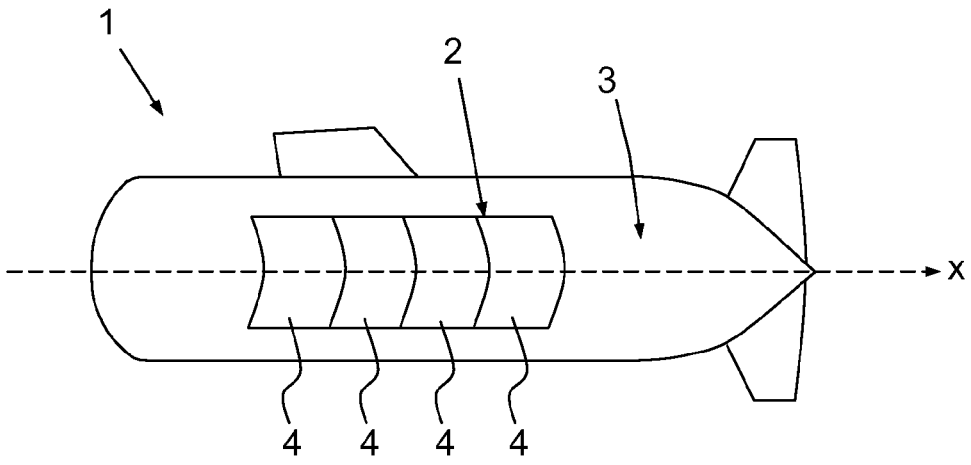
FIG. 1 represents diagrammatically an antenna in accordance with the invention.

FIG. 1 represents diagrammatically an acoustic antenna 2 in accordance with the invention for receiving underwater waves. This antenna 2 is formed of a succession of acoustic panels 4 pressed against a support 3 by means of mounting devices comprising clamping devices not represented in FIG. 1.

In the example represented in FIG. 1, the support 3 is the wall of the hull of a submarine 1. Here the panels are mounted on one flank of the submarine. An acoustic antenna could equally well be fixed to another type of support, for example on another type of marine craft, such as on the submerged portion of the wall of the hull of a boat, for example.

Figure 2:
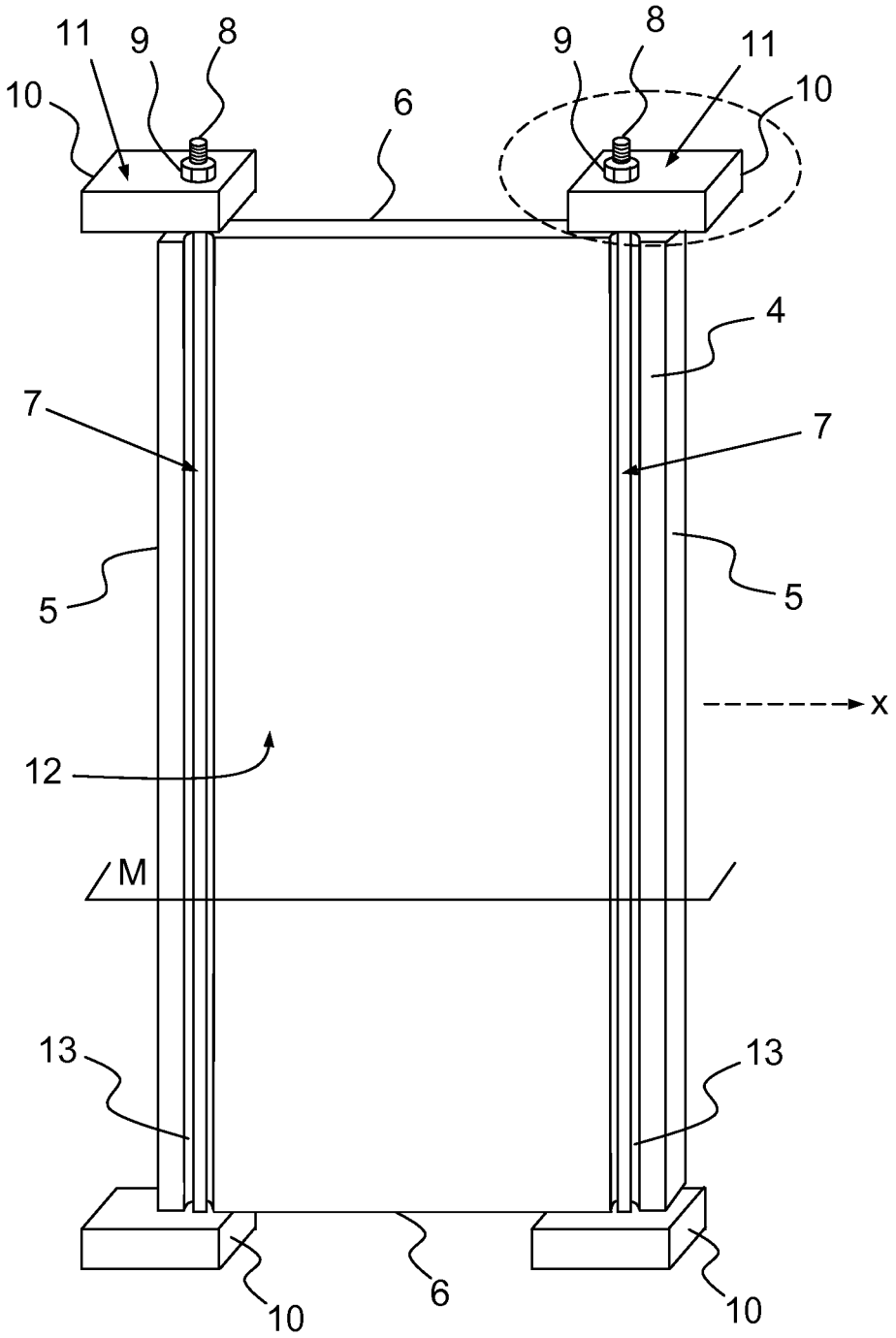
FIG. 2 represents diagrammatically an antenna element in accordance with one embodiment of the invention.

In FIG. 2 there has been represented an element of the acoustic antenna, said element comprising an acoustic panel 4 and one example of a device for clamping this panel 4 against the wall of the hull of the submarine.

The acoustic panels 4 take the form of globally rectangular flexible panels.

To be more precise, the panels have the overall shape of a thin rectangular parallelepiped. By thin parallelepiped is meant a parallelepiped the thickness of which is at least three times less than the width of the panel (which is itself less than its height). It is considered in the remainder of the text that such a panel is globally rectangular.

They have two opposite longer sides 5 (extending in the direction of the height of the panels) and two opposite shorter sides 6 (extending in the direction of the width of the panels).

Given that the hull of a submarine has a curved shape, the panels have a degree of freedom in bending so as to mate with the shape of the hull of the submarine. In the embodiment in the figures, the submarine has a cylindrical general shape with its axis X corresponding to the axis of the submarine. In this embodiment, the shorter edges 6 of the panels 4 are parallel to this axis X. In other words, the support 3 is convex between the shorter sides 6 of the panels 4. Here the degree of freedom in bending of the panels 4 is therefore a degree of freedom in rotation about an axis parallel to the shorter edges 6.

A variant would consist in disposing panels on a convex support between its two longer edges 5. The panels would then have to have a degree of freedom in bending about an axis parallel to these longer sides.

The acoustic panels are known to the person skilled in the art. A brief, non-limiting description of them is given hereinafter.

The acoustic panels are acoustic sensors. They comprise at least one acoustic pick-up, for example a plurality of acoustic pick-ups.

Point-type acoustic pick-ups may be used, for example, such as simple hydrophones, for example, or area-type pick-ups. The acoustic pick-ups are enclosed in a watertight flexible jacket for protecting the acoustic pick-ups from moisture.

The flexible jacket is a homogeneous structure, for example. It may equally be a composite structure comprising an exterior envelope enclosing at least one packing material, the pick-ups being embedded in a packing material. In the case of a composite jacket, the exterior jacket serves as a mold for the packing material or materials that it encloses.

The pick-ups may be embedded in a packing material in the form of a soft polyurethane. By soft polyurethane is meant a polyurethane the Shore A hardness of which is typically less than 50.

For example, an exterior jacket made of neoprene rubber or neoprene rubber and a hard polyurethane, typically having a Shore hardness of at least 70, may be used, the hard polyurethane serving to fill the space formed by the exterior jacket.

The device for clamping an acoustic panel against its support will now be described in more detail with reference to FIG. 2.

The device for clamping an acoustic panel comprises two flanges 7 mounted on the support 3. Each clamp comprises between its two ends at least one tie 8. The flanges provide the interface between the acoustic panel and the rest of the submarine 10.

By tie 7 is meant a flexible, i.e. bendable, object of elongate shape. This refers to metal, for example steel, cables, for example. These cables may advantageously be coated with a flexible sheath, for example made of rubber. This sheath then makes it possible to prevent the ties from damaging the panel 4 when they clamp the panel against the support 3.

The ties may form flexible strips, in which case they are referred to as straps, or have a round section. The use of straps makes it possible to distribute the pressure forces exerted by the ties on the acoustic panel. This makes it possible to ensure good retention of the panel without causing premature wear thereof.

Moreover, the use of ties (straps or cables) also has acoustic advantages. They degrade acoustic performance less than a rigid flange, in particular if acoustic pick-ups disposed in the acoustic panel are sandwiched between a tie and the support.

The ties are advantageously made from a material that is optimized with regard to the acoustic performance required on the panel. Cloth, polypropylene or polyester straps are used, for example. Composite material, for example glass fiber or carbon fiber, cables are used, for example.

The ties advantageously have a maximum width of 5 cm and a maximum thickness of 1 cm. These sections make it possible to preserve good acoustic performance even at high frequencies, in particular if acoustic pick-ups disposed in the acoustic panel are sandwiched between a tie and the support. Acoustic performance degraded by around 1 dB is acceptable.

The clamping device further comprises means for adjusting the tension of the ties between their respective two ends. These means are adapted to tension the ties longitudinally between their respective ends and to adjust this tension.

The flanges 7 are such that the support is curved between the respective two ends of the ties and the flanges clamp the panel against the support via the ties when the ties are under tension.

In the non-limiting embodiment of FIG. 2, the flanges 7 consist of a tie. The clamping effect is obtained by exerting a longitudinal tension in the flange, which results in a force in the radial direction of the hull of the submarine. By virtue of the traction force at its two ends 8 the flange 7 tends to take the shortest line, the effect of which is to sandwich the panel 4 between the flanges 7, here the ties, and the support 3.

The flanges 7 extend continuously from a first edge to the opposite edge of the panel, between which the support is curved. In other words, a convex line joins the respective two ends of the ties. In the FIG. 2 embodiment, the first edge and the opposite second edge are respective shorter edges 6 of the panel. In other words, in this embodiment, the flanges 7 extend continuously over all the length of the panel. In a variant, however, the flanges could extend continuously over all the width of the panel, for example, if the support were curved between the two longer edges of the panel.

When the flanges 7 are tensioned between their respective ends, because of the convexity of the support between their two respective ends, they are automatically clamped against the panel 4, which holds the panel 4 against the support 3. In fact, by exerting a longitudinal tension in the flange that is reflected in a traction force tangential to the hull of the submarine at each end of the flange, the flange tends to take the shortest line and so clamps the panel against the support.

In the FIG. 2 embodiment, the flanges 7 are disposed in the vicinity of the respective two longer sides 5 of the panel 4. They extend along these longer sides.

Alternatively, the clamping means comprise more than two flanges 7. For example, an additional flange 7 may be disposed in the central part of the panel 4, for example along the longer sides 5, although this is not limiting on the invention.

Providing three flanges ensures improved retention of the panels against the wall of the submarine. It is then possible to use larger acoustic panels.

Increasing the size of the panels addresses the requirement to dispose more individual hydrophones within the same jacket, which also makes it possible to reduce considerably the cost of the antenna, the latter being directly related to the number of objects (panels) installed on the submarine.

Panels having a height between 1 m and 2 m are preferably used.

If the panels are fixed by means of two flanges, panels are preferably used having a width between 40 cm and 60 cm. If the panels are fixed by means of more than two flanges, panels are preferably used having a width between 60 cm and 150 cm.

In the nonlimiting example represented in FIG. 2, the means for adjusting the tension of the ties between their two ends comprise threaded tips 8 fastened to respective ends of the flanges 7. Each threaded tip 8 cooperates with a nut 9 butted against abutment members 10 to retain the ends of the flanges 7 relative to the support 3 and to tension them between their two ends.

Figure 3:
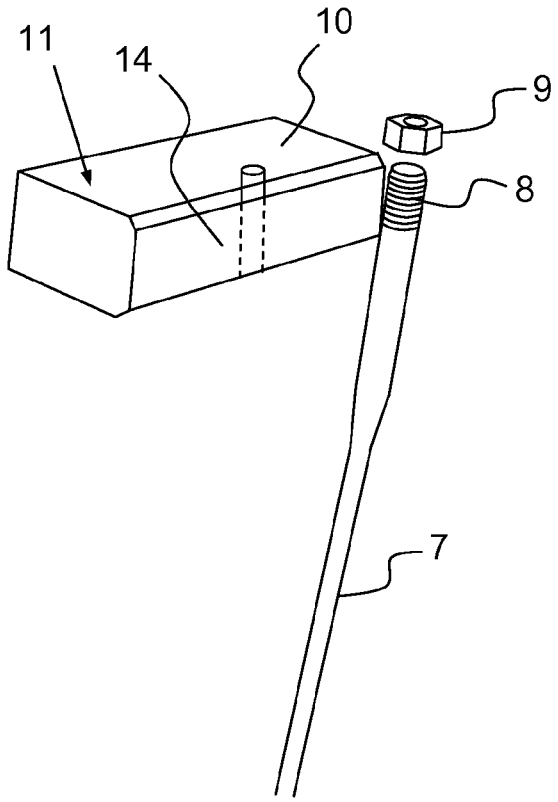
FIG. 3 represents a diagrammatic exploded view of means contained in the dashed-line bubble in FIG. 2.

In the FIG. 2 embodiment, these elements are seen for only one end of each flange 7. However, these elements and how they function are the same at each end of each flange. The elements contained in the dashed-line bubble in FIG. 2 are represented in more detail in an exploded view in FIG. 3.

The abutment members are rails (or studs) 10 disposed on either side of the panel 4 and contiguous with the respective shorter edges 6 of the panel 4. The rails 10 are fastened to the hull of the submarine and extend longitudinally parallel to the axis of the submarine. These rails also have a function of orienting the panel 4. In fact, the shorter edges 6 of the panels are abutted against the faces of these rails that are adjacent the shorter sides of the panels.

The rails 10 have faces 11 opposite the shorter edges 6 of the panels that are globally perpendicular to the wall of the submarine.

The threaded tips 8 penetrate passages 14 provided in these rails 10 and the nuts 9 are abutted against the faces of the rails opposite the shorter edges 6 of the panels.

Accordingly, when the nuts 9 are screwed onto the two threaded tips 8 of a tie, because the nuts 9 are abutted against the abutment members 10, traction forces globally tangential to the wall of the submarine are exerted on these tips 8. The components of these tangential traction forces along a straight line segment connecting the points of application of the force between the tips and the nuts 9 are in opposition, the effect of which is to tension the ties 7.

It may be noted that, as the nuts 9 are abutted against the abutment members 10 fastened to the support 3, the means for adjusting the tension of the ties 7 also constitute means for retaining the ends of the flanges fixed relative to the support 3, i.e. means for mounting these ends on the support 3.

Accordingly, because of the curvature of the hull of the submarine between the two ends of each flange 7, each flange under tension is automatically pressed against the acoustic panel and therefore clamps the acoustic panel against the hull of the submarine.

Moreover, the threaded rods 8 have a predetermined length. This makes it possible to adjust the lengths of the ties 7 between their two ends, the effect of which is to tension the ties 7 even if the hull of the submarine has different radii of curvature. Moreover, this feature makes it possible to adjust the pressure exerted by the ties 7 on the panel 4.

Thus a single clamping device may be provided to clamp the acoustic panels 4 onto supports having different radii of curvature. A single device may be used on a submarine having a varying radius of curvature or on different submarines having different radii of curvature. Moreover, the clamping device clamps the panel against the hull of the submarine even if the latter features irregularities and is not perfectly convex. Moreover, this clamping device makes it possible to prevent premature wear of the acoustic panels by the means for adjusting the tension of the ties.

An antenna in accordance with the invention comprising one or more elements in accordance with the invention is therefore of low cost and resistant to hydrodynamic stresses (because the acoustic panels are well clamped against their support).

Moreover, the antenna in accordance with the invention has good acoustic performance because of the use of ties.

Alternatively, ties may first be provided fastened at one of their ends only to a threaded rod adapted to cooperate with a nut as described above so as to fix said end to the support and to adjust the tension of the tie between its two ends, the second end being made fixed relative to the support by other fixing means.

In the embodiment described above, the flange consists of a tie. Alternatively, the flange comprises between its two ends one or more ties and means for adjusting the tension of the ties.

Figure 4:
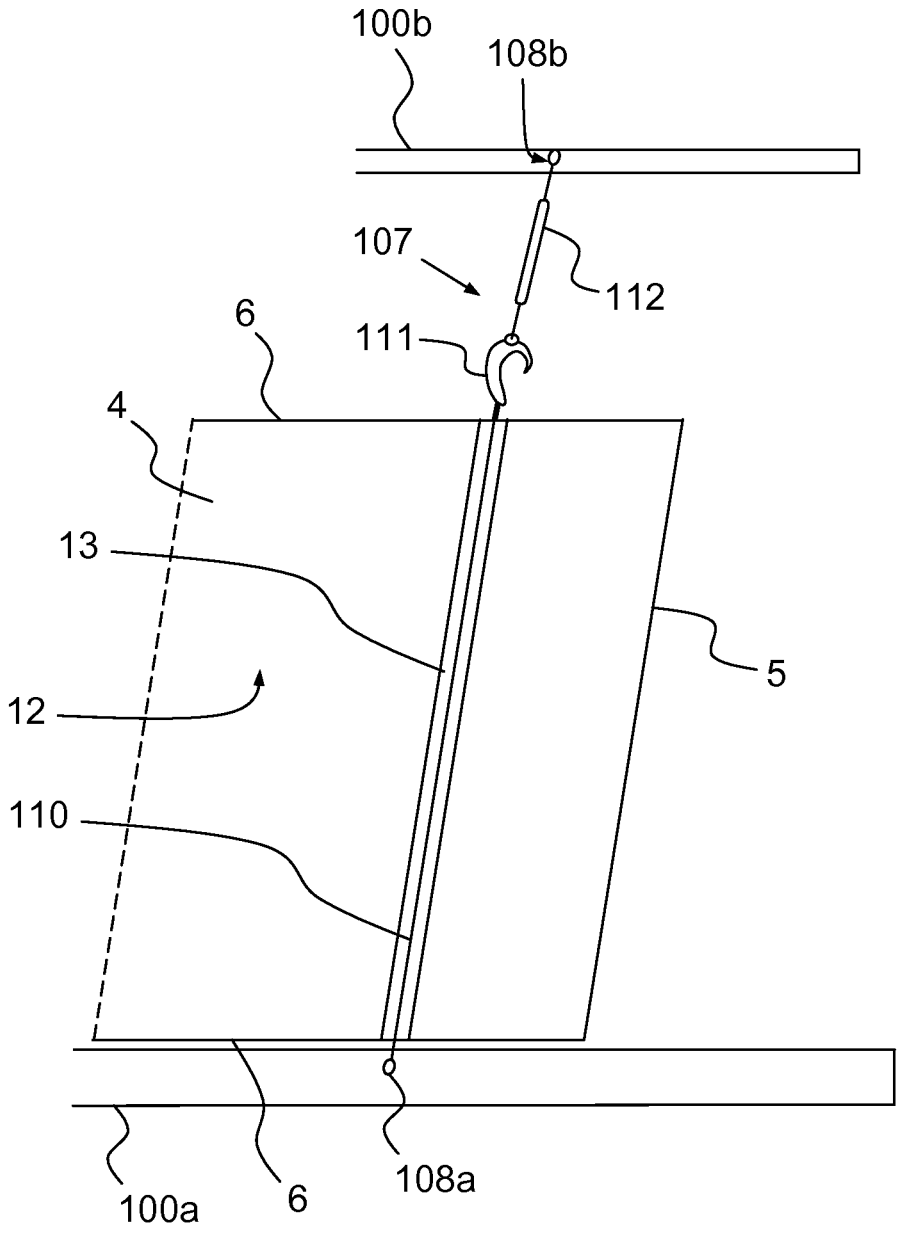
FIG. 4 represents diagrammatically a portion of an element in accordance with a variant of the invention.

One example of this variant is represented in FIG. 4, which represents a portion of a panel 4 installed as in FIG. 1.

In this example, the clamping device comprises means 108*a*, 108*b* for fixing the respective ends of a flange 107 to respective rails 100*a*, 100*b* fastened to the support 3, not shown. The flange 107 extends continuously over all the length of the panel 4 between its shorter edges 6. To be more precise, it extends parallel to the longer sides 5 of the panel 4.

The flange 107 comprises a tie 110. The tie 110 extends continuously over all the length of the panel.

As in the previous embodiment, the flange 107 is adapted to clamp the panel 4 against the support 3 via the tie 110 when the tie 110 is tensioned. Firstly, the flange 107 is such that the support is curved between the two ends of the tie 110. More generally, in this embodiment, the support 3 is curved between the two ends of the flange.

Moreover, the panel is sandwiched between the flange 107 and the support 3.

To be more precise, the panel 4 is sandwiched between the tie 110 and the support 3. The tie 110 extends continuously over all the length of the panel 4 between its shorter edges 6. Accordingly, when the tie is tensioned, the flange clamps the panel 4 via the tie 110.

The means for adjusting the tension of the tie 110 between its two ends comprise a cable tensioner 112. A cable tensioner conventionally comprises two threaded rods that screw into the same threaded body. When the free body is turned between the two rods, this tends to screw each of the rods into the body. The two rods move toward each other and the length of the device is reduced.

A first end of the cable tensioner constitutes a first end of the flange 107 and is fixed to the support by first fixing means 108*b*. The second end of the tensioner 112 is fixed to a first end of the tie 110 by means of a hook device 111. The second end of the tie 110 constitutes the second end of the flange 107 and is fixed to the support by means of the second fixing means 108*a*.

When the length of the tensioner 112 is reduced, it tensions the tie 110 between its two ends. Because the hull of the submarine is curved between the two ends of the tie, the tie then clamps the panel 4 against the support 3. The flange therefore clamps the panel 4 against the support via the tie 110 alone.

Alternatively, the means for adjusting the tension of the tie may be disposed between the two shorter edges 6 of the panel 4. The flange then clamps the panel via the tie and via the means for adjusting the tension of the tie when the tie is tensioned. However, the acoustic performance of the device is improved if the flange clamps the panel only by means of the tie.

Generally speaking, an adjustable clamp or a ratchet-type clamping device or a cable tensioner may be installed between the two fixed ends of the flange.

Each flange may comprise one or more ties and means for adjusting the tension of the tie or ties.

The acoustic panels have an internal face, not visible in the figures, disposed against the wall of the hull of the submarine and an external face 12, visible in FIGS. 2 and 4, facing the exterior environment of the submarine, or more generally external to the support.

The external face 12 of the acoustic panels is advantageously plane at least in its central part. This feature is necessary to disturb the hydrodynamics of the submarine as little as possible.

Figure 5:
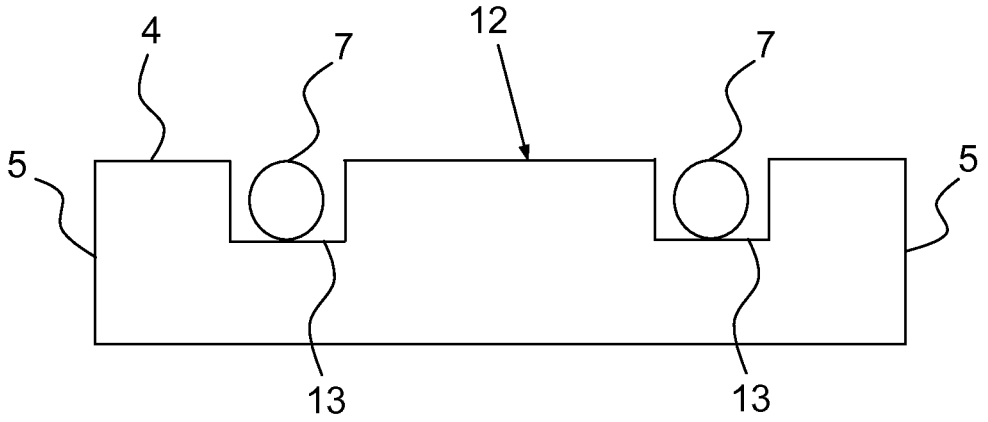
FIG. 5 represents diagrammatically a view in section on the plane M of the element represented in FIG. 2.

As represented in FIG. 2 and in FIG. 5, representing a section of the element from FIG. 2 on the plane M, the ties are advantageously at least partially accommodated in channels 13 opening onto the external face 12 of the panel 4. Here the channels 13 extend over all the length of the panel 4 but they could extend over all its width. The ties 7 are advantageously flush with the external face 12 of the panel 4.

This feature makes it possible to limit the disturbance of the hydrodynamics of the submarine caused by the antenna.

However, the surface formed by the ties 7 and the external face of the panel 4 is not necessarily plane. This is the case if the channels are wider than the ties that are accommodated in them, for example, as represented in FIG. 5.

The volume of a channel 13 that is not occupied by a tie 7 is advantageously caulked with a caulking material so that the surface formed by the caulking material and the ties 7 is flush with the external face of the panel.

The ties are advantageously fastened to the panel that they clamp. This solution is very advantageous in terms of the simplicity of mounting the antenna on its support. A single step is necessary to attach the panel and the ties to the wall of the submarine. It is not necessary to attach these elements separately.

The invention also consists in a method of mounting an acoustic panel on a support, comprising:

a step in which the panel is attached to a support, a step in which the panel is clamped against the support by means of a clamping device comprising at least two flanges each comprising at least one tie between its two ends and means for adjusting the tension of said ties between their respective two ends, said clamping step comprising a step in which said flanges are arranged so that the support is curved between the respective two ends of said ties and so as to clamp the panel against the support via said ties under tension.

The ties are advantageously fastened to the panel when the panel is mounted on the support.

In an even more advantageous solution, it is the flanges that are fastened to the panel that they clamp.

It is possible, for example, in the solutions described above, to fix, for example, to glue, the ties to the panels that they are intended to clamp.

Figure 6:
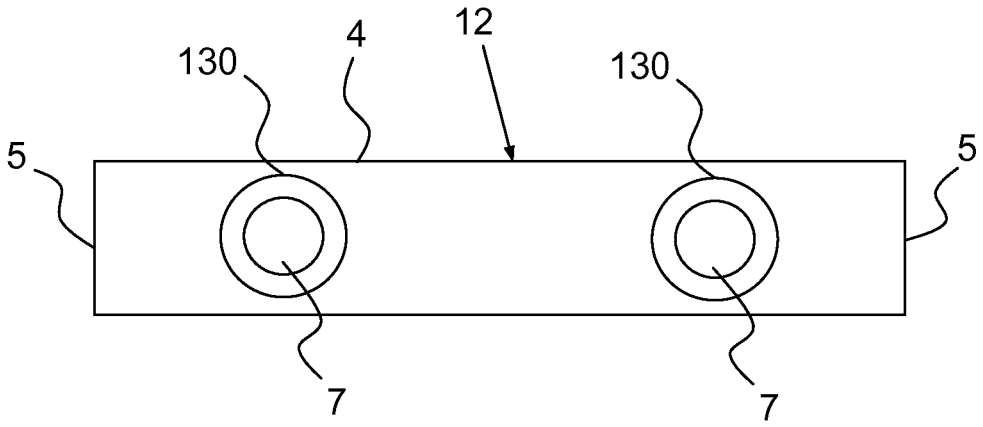
FIG. 6 represents a variant of the FIG. 5 sectional view.

In a variant represented in FIG. 6, the ties 7 are at least partially accommodated in passages 130 inside the panel 4 and extending over all the length or the width (if the support is curved between the longer edges of the panel 4). The passages open on either side of the acoustic panel.

This feature is advantageous both in terms of simplicity of mounting but also because it limits the disturbance to the hydrodynamics of the submarine caused by the antenna. In fact, because the passages are inside the panel, no element of the clamping device covers the external face of the panel.

Moreover, because the ties 7 extend over all the length of the acoustic panel in the passages 130 inside the panel 4, they automatically clamp the panel against the support when they are tensioned by virtue of coming to bear on the surface of the passage.

The invention claimed is:

1. An acoustic antenna element for receiving and/or emitting low-frequency underwater waves, comprising an acoustic panel formed by at least one acoustic pick-up enclosed in a flexible jacket, said acoustic panel being generally rectangular and being mounted against a curved support by means of a mounting device including a clamping device comprising at least two flanges the ends of which are mounted on said support, characterized in that the respective flanges comprise at least one tie between the two ends thereof, and in that the clamping device comprises means for adjusting the tension in said ties between the two respective ends thereof, the flanges being arranged so that the support is curved between the two respective ends of said ties and so that the panel is clamped against the support by said ties when they are under tension.

2. The acoustic antenna element as claimed in claim 1, wherein at least one of said ties takes the form of a flexible strip.

3. The acoustic antenna element as claimed in claim 1, wherein at least one of said ties takes the form of a metal cable sheathed by means of a flexible sheath.

4. The acoustic antenna element as claimed in claim 1, wherein at least one of said flanges consists of a tie.

5. The acoustic antenna element as claimed in claim 1, wherein at least one of said ties is fastened to the panel.

6. The acoustic antenna element as claimed in claim 1, wherein the panel is sandwiched between at least one of said ties and the support.

7. The acoustic antenna element as claimed in claim 6, wherein said at least one of said ties is at least partially accommodated in a channel opening onto the face of the panel facing the environment external to the support, referred to as the external face.

8. The acoustic antenna element as claimed in claim 7, wherein said at least one of said ties is flush with the external face of the panel.

9. The acoustic antenna element as claimed in claim 7, wherein the volume of said channel that is not occupied by said at least one of said ties is caulked by means of a caulking material so that the surface formed by the caulking material and said at least one of said ties is flush with the external face of the panel.

10. The acoustic antenna element as claimed in claim 1, wherein at least one of said ties is at least partially accommodated in a passage extending over all the length or over all the width of said panel.

11. The acoustic antenna element as claimed in claim 1, wherein the clamping means comprise at least three flanges.

12. The acoustic antenna element as claimed in claim 1, wherein the flanges are adapted to clamp the panel (4) against the support (3) exclusively via said ties under tension.

13. An antenna comprising a plurality of elements as claimed in claim 1.

14. A ship equipped with an antenna as claimed in claim 13.

15. A method of mounting an acoustic panel formed by at least one acoustic pick-up enclosed in a flexible jacket, said acoustic panel being globally rectangular, against a curved support, comprising:

a step in which the panel is attached to a support, a step in which the panel is clamped against the support by means of a clamping device comprising at least two flanges each comprising at least one tie between its two ends and means for adjusting the tension of said ties between their respective two ends, said clamping step comprising a step in which said flanges are arranged so that the support is curved between the respective two ends of said ties and so as to clamp the panel against the support via said ties under tension, said ties being fastened to the panel when the panel is mounted on the support.

* * * * *